US007685774B2

(12) United States Patent
Thielmann

(10) Patent No.: US 7,685,774 B2
(45) **Date of Patent: *Mar. 30, 2010**

(54) CLOSING SYSTEM FOR SEALING SYSTEM OF SLIDING DOOR/WINDOW

(75) Inventor: Jonathan D. Thielmann, Delray Beach, FL (US)

(73) Assignee: Speyer Door and Window, Inc., Boca Raton, FL (US)

( * ) Notice: Subject to any disclaimer, the term of this patent is extended or adjusted under 35 U.S.C. 154(b) by 932 days.

This patent is subject to a terminal disclaimer.

(21) Appl. No.: 11/322,888

(22) Filed: Dec. 30, 2005

(65) Prior Publication Data

US 2007/0151156 A1 Jul. 5, 2007

(51) Int. Cl.
*E05D 13/00* (2006.01)

(52) U.S. Cl. ..... 49/411; 49/409; 49/410; 49/483.1; 49/475.1; 49/476.1; 49/303; 49/304; 49/449; 49/306; 49/307; 49/309

(58) Field of Classification Search ..... 49/409–411, 49/483.1, 475.1, 476.1, 303, 304, 316, 449, 49/458, 306, 307, 309
See application file for complete search history.

(56) References Cited

U.S. PATENT DOCUMENTS

| | | | | |
|---|---|---|---|---|
| 724,139 | A | 3/1903 | Smith | |
| 1,178,775 | A | 4/1916 | Albright | |
| 1,715,188 | A * | 5/1929 | Bullock et al. | 49/411 |
| 1,977,726 | A * | 10/1934 | Jacobson | 49/411 |
| 1,995,939 | A | 3/1935 | Osten | |
| 2,207,065 | A | 7/1940 | McCormick | |
| 2,248,719 | A | 7/1941 | Owen | |
| 2,268,114 | A | 12/1941 | Foster et al. | |
| 2,562,369 | A | 5/1951 | Currie | |
| 2,753,020 | A | 7/1956 | Ware | |
| 2,805,451 | A | 9/1957 | Evans et al. | |

(Continued)

OTHER PUBLICATIONS

Patio Life—Operation; http://www.rotohardware.com/Products/Patio%20Life/PL-Operation.htm.

*Primary Examiner*—Katherine W Mitchell
*Assistant Examiner*—Jeff Tang
(74) *Attorney, Agent, or Firm*—Scott D. Paul, Esq.; Steven M. Greenberg, Esq.; Carey, Rodriguez, Greenberg & Paul, LLP

(57) ABSTRACT

A closing system for moving a sealing system between an unlocked configuration and a locked configuration includes first and second inner control members and first and second outer control members. The sealing system connects a panel to a frame and includes an anchor disposed between first and second opposing docking collars. The first and second inner control members are respectively connected to the first and second docking collars, and the first and second outer control members are respectively disposed proximate to the first and second inner control members. The first and second outer control members move relative to the first and second inner control members along a line substantially perpendicular to a longitudinal axis of one of the control members, and movement of the first and second outer control members relative to the first and second inner control members along the line generates forces against the first and second inner control members towards the anchor when the sealing system moves from the unlocked configuration to the locked configuration.

6 Claims, 17 Drawing Sheets

U.S. PATENT DOCUMENTS

| | | | | | |
|---|---|---|---|---|---|
| 2,862,262 | A | | 12/1958 | Shea | |
| 3,004,309 | A | | 10/1961 | Korodi | |
| 3,059,287 | A | | 10/1962 | Baruch et al. | |
| 3,070,856 | A | | 1/1963 | Minick | |
| 3,098,519 | A | | 7/1963 | Meyer et al. | |
| 3,184,806 | A | * | 5/1965 | Bragman | 49/226 |
| 3,252,255 | A | | 5/1966 | Marpe | |
| 3,383,801 | A | | 5/1968 | Dallaire | |
| 3,466,801 | A | | 9/1969 | Bohn | |
| 3,660,936 | A | | 5/1972 | Bryson | |
| 3,816,966 | A | | 6/1974 | Sause, Jr. | |
| 3,818,636 | A | | 6/1974 | Calais et al. | |
| 3,821,884 | A | * | 7/1974 | Walsh | 70/95 |
| 3,848,908 | A | * | 11/1974 | Rich | 292/189 |
| 3,857,199 | A | | 12/1974 | Frach et al. | |
| 4,027,431 | A | * | 6/1977 | Rackard | 49/458 |
| 4,128,967 | A | | 12/1978 | Kirsch | |
| 4,307,542 | A | | 12/1981 | Lense | |
| 4,322,914 | A | * | 4/1982 | McGaughey | 49/370 |
| 4,392,329 | A | | 7/1983 | Suzuki | |
| 4,413,446 | A | | 11/1983 | Dittrich | |
| 4,453,346 | A | * | 6/1984 | Powell et al. | 49/404 |
| 4,535,563 | A | | 8/1985 | Mesnel | |
| 4,656,779 | A | | 4/1987 | Fedeli | |
| 4,716,693 | A | * | 1/1988 | Webster | 52/64 |
| 4,870,909 | A | | 10/1989 | Richter | |
| 4,936,049 | A | | 6/1990 | Hansen | |
| 5,007,202 | A | | 4/1991 | Guillon | |
| 5,029,911 | A | | 7/1991 | Daniels | |
| 5,339,881 | A | | 8/1994 | Owens | |
| 5,446,997 | A | * | 9/1995 | Simonton | 49/458 |
| 5,511,833 | A | * | 4/1996 | Tashman et al. | 292/145 |
| 5,569,878 | A | | 10/1996 | Zielinski | |
| 5,584,142 | A | * | 12/1996 | Spiess | 49/411 |
| 5,786,547 | A | | 7/1998 | Zielinski | |
| 5,870,859 | A | | 2/1999 | Kitada | |
| 6,041,552 | A | * | 3/2000 | Lindahl | 49/458 |
| 6,082,047 | A | | 7/2000 | Comaglio et al. | |
| 6,105,313 | A | | 8/2000 | Holloway et al. | |
| 6,112,467 | A | | 9/2000 | Bark et al. | |
| 6,170,195 | B1 | * | 1/2001 | Lim | 49/196 |
| 6,173,533 | B1 | | 1/2001 | Cittadini et al. | |
| 6,243,999 | B1 | | 6/2001 | Silverman | |
| 6,289,643 | B1 | | 9/2001 | Bonar | |
| 6,442,899 | B1 | | 9/2002 | Gledhill | |
| 6,490,832 | B1 | | 12/2002 | Fischbach et al. | |
| D470,252 | S | | 2/2003 | Castrey | |
| 6,644,884 | B2 | | 11/2003 | Gledhill | |
| 6,651,389 | B2 | | 11/2003 | Minter | |
| 7,124,538 | B1 | | 10/2006 | Kline | |
| 7,487,616 | B2 | * | 2/2009 | Deaver | 49/498.1 |
| 2005/0097842 | A1 | | 5/2005 | Arcamonte et al. | |

* cited by examiner

CLOSING SYSTEM FOR SEALING SYSTEM OF SLIDING DOOR/WINDOW

CROSS-REFERENCE TO RELATED APPLICATIONS

This application is related to U.S. application Ser. No. 11/322,952 filed on Dec. 30, 2005, and to U.S. application Ser. No. 11/322,953, filed on Dec. 30, 2005.

BACKGROUND OF THE INVENTION

1. Field of the Invention

The disclosure relates generally to sealing systems for use with panels, such as a door or a window, within a frame and, more specifically, to a sealing system for providing an improved seal between meeting stiles of adjacent panels and between a panel and frame.

2. Description of the Related Art

Certain types of panels, such as doors and windows, are positioned within openings of a wall and/or other structures using a frame. These panels may also open and close by sliding back and forth within the frame. An issue associated with these types of panels is the integrity of the seals between the panels and the frame and between adjacent meeting stiles of a pair of panels. In many instances, these seals are an insufficient barrier in preventing the transfer from one side of the panel to the other side of the panel of such environmental elements as noise, weather, water, and insects.

Examples of conventional connections between the meeting stiles of a pair of panels and between a frame and a panel are respectively illustrated in FIGS.1A and 1B. In FIG. 1A, a first panel 10A and a second panel 10B each include a bottom rail 25 and a glass panel 32. Also, the first panel 10A includes a first meeting stile 20A that engages a second meeting stile 20B of the second panel 10B at interlocking extensions 22A, 22B of the first and second meeting stile 20A, 20B. Each extension 22A, 22B may respectively include brush seals 24A, 24B that engage a portion of the other extension 22A, 22B. These seals 24A, 24B, however, are not always capable of preventing elements, such as noise, weather, water, and insects, from breaching the seals. Moreover, if the panels 10A, 10B are slightly misaligned, one or both of the seals 24A, 24B may not properly engage the opposing interlocking extension 22A, 22B.

FIG. 1B illustrates the connection between a sill 38 of a frame 41 and a bottom rail 25 of a pair of panels 10A, 10B. Each bottom rail 25 includes a roller assembly 30 having a wheel 37 that is attached to the bottom rail 25 with an axle 40. The panels 10A, 10B slide relative to the frame 41 using the wheels 37 along a track 39 attached to the sill 38. However, gaps exists between the rollers 70 and the bottom rail 25 and between the wheels 37 and the track 39 since the wheels 37 only engage the track 39 at certain positions. As a result of these gaps, an effective seal is not provided between the frame 41 and the panels 10A, 10B.

Attempts have been made to address these issues by using various types of weather stripping between the panels and frame. For example, the weather stripping may be strip of felt, foam, or a pile of flexible synthetic material. In many instances, however, this weather stripping fails to act as a sufficient seal between the panels and frame. There is, therefore, a need for a sealing system that can be employed between a frame and panel or between adjacent panels that prevents the transfer from one side of the panel to the other side of the panel such environmental effects as noise, weather, water, heat/cold, and insects Another issue prevalent associated with the seals between a frame and panel or between adjacent panels is that these seals can become disjoined. Either intentionally or unintentionally, the alignment between the frame and panel or between adjacent panels may be disturbed which can degrade the quality of the seal, since, in many instances, the integrity of the seal relies upon these members having certain positional relationships relative to one another. There is, therefore, also a need for a sealing system that maintains the positional relationships between the frame and panel or between adjacent panels.

BRIEF SUMMARY OF THE INVENTION

Embodiments of the invention address deficiencies of the art with respect to effectively creating a seal between a panel and a frame or between two panels. In this regard, a closing system for moving a sealing system between an unlocked configuration and a locked configuration includes first and second inner control members and first and second outer control members. The sealing system connects a panel to a frame and includes an anchor disposed between first and second opposing docking collars. The first and second inner control members are respectively connected to the first and second docking collars, and the first and second outer control members are respectively disposed proximate to the first and second inner control members. The first and second outer control members move relative to the first and second inner control members along a line substantially perpendicular to a longitudinal axis of one of the control members, and movement of the first and second outer control members relative to the first and second inner control members along the line generates forces against the first and second inner control members towards the anchor when the sealing system moves from the unlocked configuration to the locked configuration.

In certain aspects of the closing system, the movement, along the line, of the first and second outer control members relative to the first and second inner control members moves each of the first and second inner control members towards the anchor. The movement of the first and second outer control members relative to the first and second inner control members also increases a distance separating a proximate pair of the inner and outer control members.

In other aspects of the closing system, each control member of a proximate pair of the inner and outer control members includes a step extending towards the other, and in the locked configuration, the steps engage one another. Also, each control member of the proximate pair of the inner and outer control members may include a plurality of separate steps. The first and second outer control members are interconnected with at least one connector.

A closing system for moving a combined sealing system between an unlocked configuration and a locked configuration includes first and second inner control members and first and second outer control members. The combined sealing system connects a first panel to a second panel and includes a first sealing system and a second sealing system. Each of the first and second sealing systems are positioned in a stile rail of the second panel and include an anchor disposed between first and second opposing docking collars. The anchor of the first sealing system is substantially parallel to the anchor of the second sealing system. The first inner control member is connected to the first docking collars of both the first and second sealing systems, and the second inner control member is connected to the second docking collars of both the first and second sealing systems. The first and second outer control members are respectively disposed proximate to the first and second inner control members. The first and second outer control members move relative to the first and second inner control members along a line substantially parallel to a longitudinal axis of one of the control members, and movement, along the line, of the first and second outer control members relative to the first and second inner control members along the line moves each of the first and second docking collars of the first and second sealing systems towards the anchors.

In certain aspects of the closing system, the first inner control member connects to first docking collar of the first sealing system via at least one first docking collar connector that connects the first docking collar of the second sealing system to the first docking collar of the first sealing system. The second outer control member connects to second docking collar of the first sealing system via at least one second docking collar connector.

A closing system for moving a combined sealing system between an unlocked configuration and a locked configuration includes first and second inner control members and first and second outer control members. The combined sealing system connects a panel to a frame and includes a first sealing system and a second sealing system. Each of the first and second sealing systems includes an anchor disposed between first and second opposing docking collars. The anchor of the first sealing system is substantially perpendicular to the anchor of the second sealing system. The first inner control member is connected to the first docking collars of both the first and second sealing systems, and the second inner control member is connected to the second docking collars of both the first and second sealing systems. The first and second outer control members are respectively disposed proximate to the first and second inner control members. The first and second outer control members are movable relative to the first and second inner control members along a line substantially parallel to a longitudinal axis of one of the control members, and movement of the first and second outer control members relative to the first and second inner control members along the line generates forces against the first and second control members towards the anchors when the sealing system moves from the unlocked configuration to the locked configuration.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIGS. 2A and 2B are side views, respectively, of a door/window system in a closed and partially opened position in accordance with the inventive arrangements;

DETAILED DESCRIPTION OF THE INVENTION

Figure 1A:
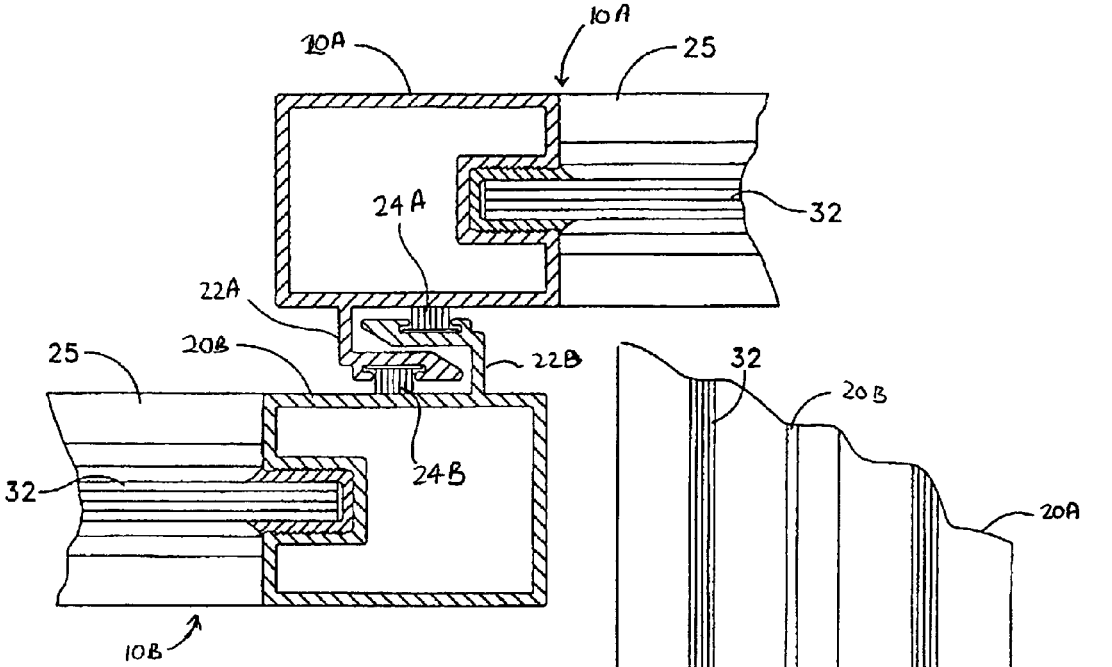
FIGS. 1A and 1B are cross-sectional views, respectively of conventional connections between adjacent panels and between a panel and a frame.
Figure 1B:
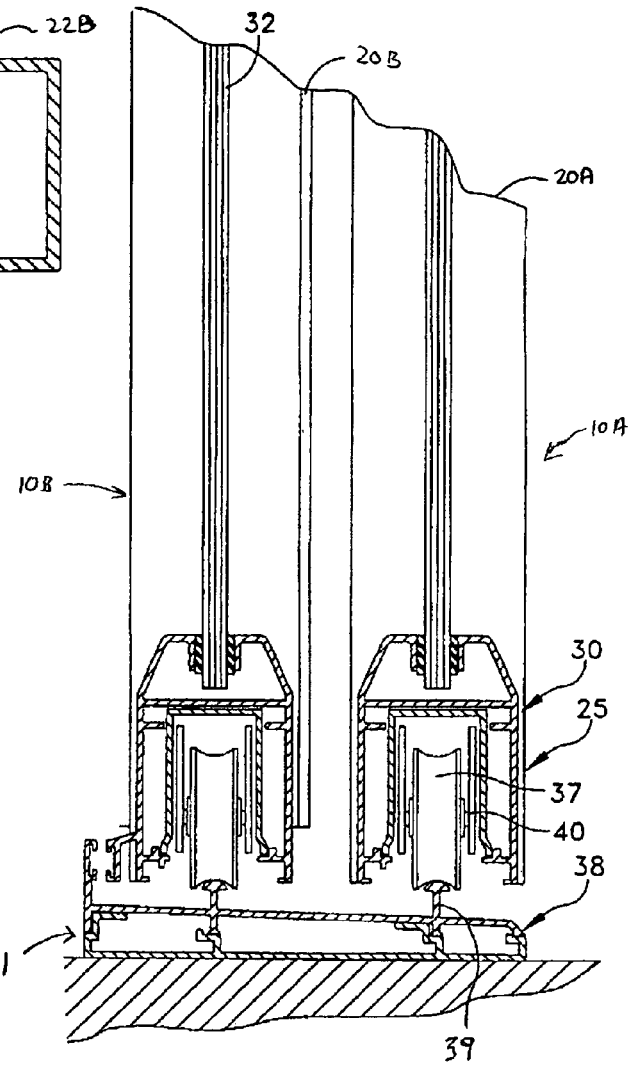
Figure 1A:
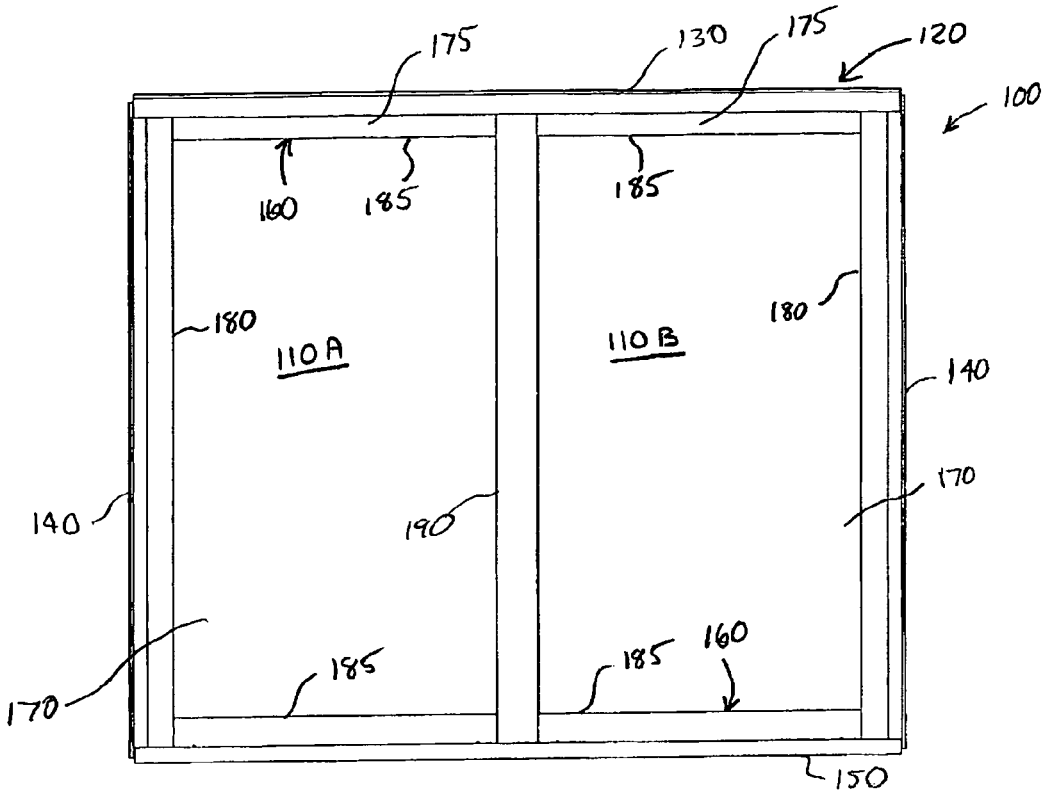
Figure 2B:
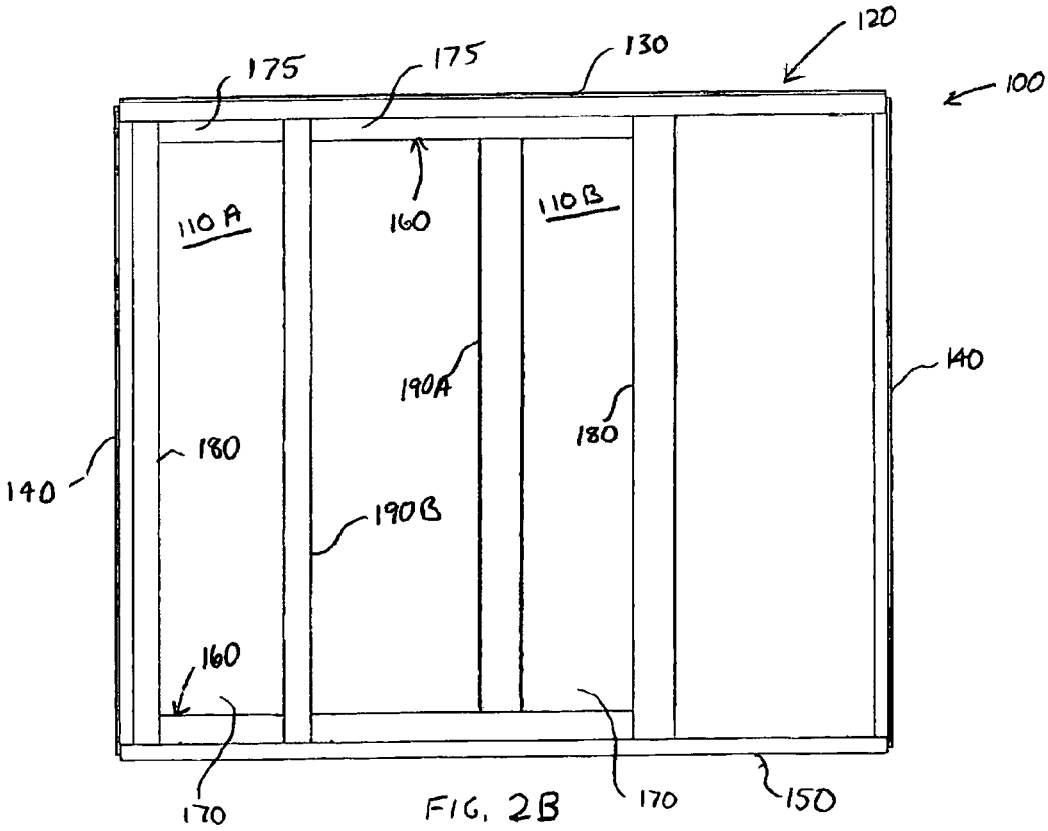

FIGS. 2A and 2B illustrate an exemplar door/window system 100 for use with the improved sealing system 200. The sealing system 200 can be used with many types of doors and/or windows, and the sealing system 200 is not limited to the particular door/window system 100 illustrated. For example, the sealing system 200 may be used with pocket doors, sliding doors, French doors, entry doors, garage doors, sliding windows, single-hung windows, double-hung windows, casement windows, and awning windows. The door/window system 100 includes panels 110A, 110B connected to a stationary frame 120. Although not limited in this manner, either one or both of the panels 110A, 110B may move relative to the frame 120 along a plane parallel to a longitudinal axis of one of the surfaces (e.g., the header 130, jambs 140, or sill 150) of the frame 120, and/or along a plane substantially parallel to a longitudinal axis of an anchor 220 of the sealing system 200, and/or substantially along a plane defined by the panel 110A, 110B.

The frame 120 may include a header 130, jambs 140, and a sill 150. A header 130 is a structural member that spans an upper portion of the window/door opening. Jambs 140 are the outermost vertical side members of the frame 120. A sill 150 is a threshold or structural member that spans a lower-most portion of the window/door opening. As recognized by those skilled in the art, different terms may also be associated with the above-structure identified as the header 130, jambs 140, and sill 150.

Each panel 110 may include a sash 160 that surrounds a pane 170. The pane 170 is not limited as to a particular material. For example, the pane 170 may be translucent, such as glass or plastic, or opaque, such as with wood or metal. The sash may include a header rail 175, jamb or stile rails 180, and a sill rail 185. As recognized by those skilled in the art, different terms may also be associated with the structure identified as the header rail 175, the jamb or stile rail 180, sill rail 185, and meeting stile 190. The respective jamb/stile rails 180 of the panels 110A, 110B that adjoin one another when the door/window system 100 is closed are also known as meeting stiles 190A, 190B.

The sealing system 200 may be used with each of the members 175, 180, 185, 190 of the sash 160 to form a seal between the sash 160 and the frame 120 or between the meeting stile 190A of one panel 110A and the meeting stile 190B of another panel 110B. In this manner each of the separate sides of the panels 110A, 110B may employ the sealing system 200. As will be described in more detail below, not only does the sealing system 200 provide at least one seal between adjacent members of sash 160 and frame 120 or between adjacent meeting stiles 190A, 190B, each of the sealing systems 200 may prevent the movement of the panels 110A, 110B relative to the frame 120. In so doing, the sealing systems 200 can act as a lock and/or security device that prevents the forced opening of the panels 110A, 110B relative to the frame 120.

To prevent the forced opening of the panels 110A, 110B, the sealing systems 200 are not limited as to a percentage of coverage between particular members of the frame 120 and/or panels 110A, 110B. For example, the sealing systems 200 may only cover a fractional number (e.g., 10%, 50%, 85%) of the length between particular members of the frame 120 and/or panels 110A, 110B. However, in certain aspects, the sealing systems 200 provide substantially complete coverage between the sash 160 of a panel 110A, 110B and the frame 120 or between the meeting stile 190A of one panel 110A and the meeting stile 190B of another panel 110B. In so doing, the combined sealing systems 200 can provide a seal substantially completely around one or both of the panels 110A, 110B.

FIGS. 3A, 4A and 3B, 4B respectively illustrate the sealing system 200 in open and closed positions. The sealing system 200 connects the sill rail 185 of the panel 110 to the sill 150 of the frame 120. As will be described in more detail below, the sealing system 200 may also be used with other members in the door/window system 100, such as the header 130 and header rail 175, the jamb 140 and the stile rail 180, and between the meeting stile 190A of the first panel 110A and the meeting stile 190B of the second panel 110B.

The sealing system 200 may include an anchor 220 and at least one docking collar 210A, 210B. Although the anchor 220 is illustrated as being associated with the sill 150 of the frame 120, and the docking collars 210A, 210B are illustrated as being positioned in a guide portion 280 that is associated with the sill rail 185 of the sash 160, the sealing system 200 is not limited in this manner. For example, the anchor 220 may be associated with the sash 160 (e.g., extending from the sill rail 185 of the sash 160) and the docking collars 210A, 210B may be associated with the frame 120 (e.g., positioned within a guide portion 280 of the sill 150 of the frame 120).

Although illustrated as having a pair of complimentary docking collars 210A, 210B, the sealing system 200 is not limited in this manner. For example, the sealing system 200 may include only a single movable docking collar 210 that engages the anchor 220. Also, the engagement between the single movable docking collar 210 and the anchor 220 may be only on a single side of the anchor 220. Alternatively, a membrane acting as the docking collar 210 may at least partially surround the anchor 220 and thus engage more than a single side of the anchor 220. In another aspect of the sealing system 200, one of the docking collars 210A, 210B is movable and the other of the docking collars 210A, 21B is stationary.

Although not limited in this manner, the anchor 220 is T-shaped and the complimentary docking collars 210A, 210B are L-shaped (and reverse L-shaped). By configuring the anchor 220 and docking collars 210A, 210B in this manner, upon the widest portions of the docking collars 210A, 210B being positioned between the wide portion of the anchor 220 (i.e., outer portion $\mathbf{220}_O$) and another surface, the outer portion $\mathbf{220}_O$ of the anchor 220 prevents movement of the docking collar 210A, 210B in a direction towards the outer portion $\mathbf{220}_O$. For example, using the reference system of FIGS. 4A, 4B, the T-shaped anchor 220 prevents upward movement of the docking collars 210A, 210B upon the widest portions of the docking collars 210A, 210B being positioned underneath the outer portion $\mathbf{220}_O$ of the anchor 220. In so doing, the sill rail 185 can be prevented from being disconnected from the sill 150.

Figure 3A:
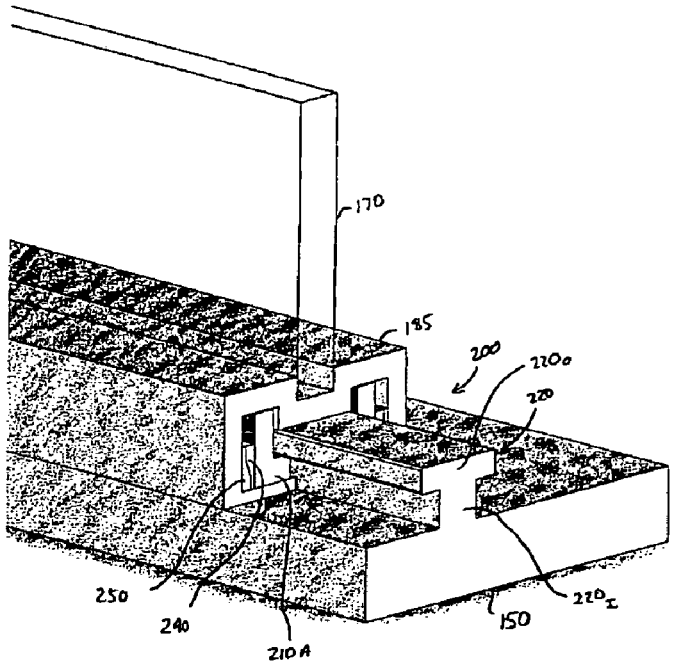
FIGS. 3A and 3B are perspective views, respectively, of a sealing system between a sill and a sill rail in locked and unlocked configurations in accordance with the inventive arrangements.
Figure 3B:
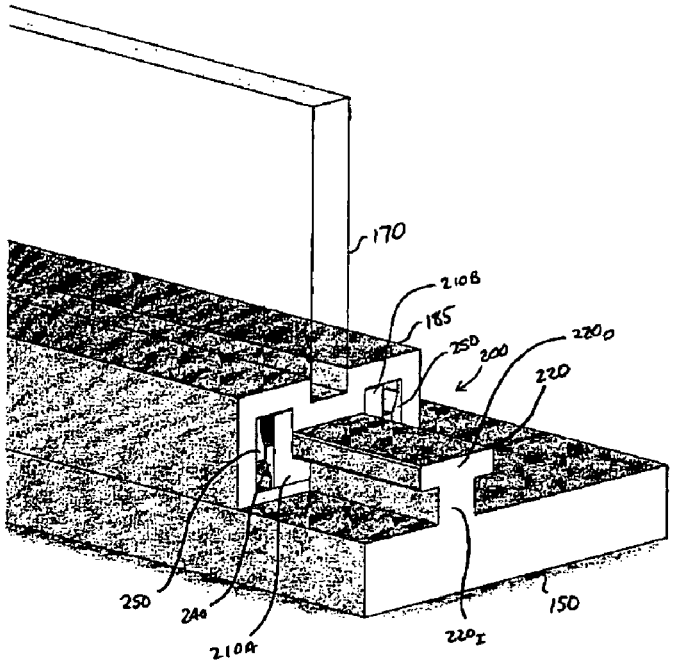
Figure 4A:
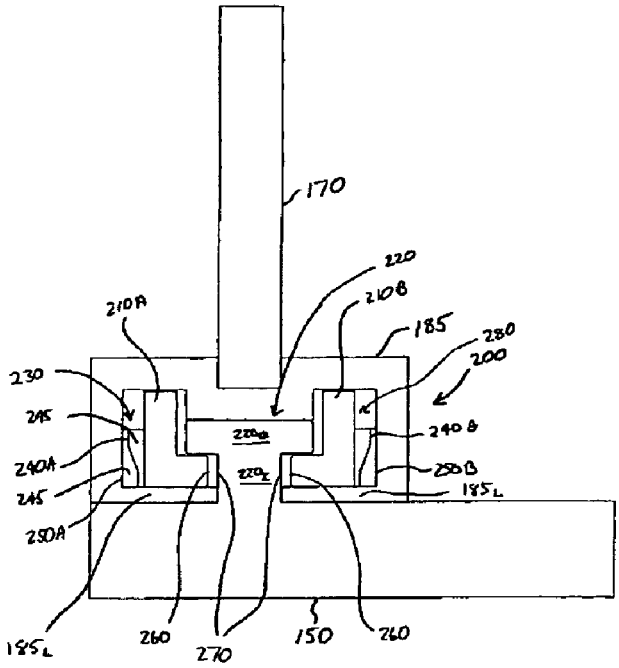
FIGS. 4A and 4B are side views, respectively, of the sealing system in FIGS. 3A and 3B.

Although the T-shaped anchor 220 illustrated in FIGS. 3A, 3B and 4A, 4B has a substantially planar top surface and upper and lower side surfaces that are substantially perpendicular to the top surface, the anchor 220 is not limited in this manner. For example, as illustrated in FIG. 5A, the anchor 220 may include a curved top surface and upper and lower side faces 270. Another example is illustrated in FIG. 5B, which shows the anchor 220 as having a generally circular outer portion $\mathbf{220}_O$ and a single set of lower sides faces 270. Also, depending upon the shape of the anchor 220, the docking collars 210A, 210B may be configured to adapt to the shape of the anchor 220. This is shown, for example, in FIGS. 5B and 5C, in which at least a portion of an inner face 260 of the docking collar 210 is adapted to mate with the side surfaces of the anchor 220. Also, in FIG. 5C, the anchor 220 may includes angled side faces, which mate with the docking collars 210A, 210B, and these angled side faces may not be perpendicular to a surface of the frame 120.

In certain aspects of the sealing system 200, the widest portions of the docking collars 210A, 210B are prevented, for example, by the guide portion 280 from moving beyond the outer portion $\mathbf{220}_O$ of anchor 220 in either the locked or unlocked configurations of the sealing system 200. In this manner, the combination of the anchor 220 and the guide portion 280 prevents the sill rail 185 from being disconnected from the sill 150.

Many different systems are known as capable of limiting the movement of one feature relative to another, and the sealing system 200 is not limited as to how this restriction of movement is accomplished. For example, as illustrated in FIG. 4, the docking collar 210B is prevented from moving away from the anchor 220 upon the inner control member 240 adjacent the docking collar 210B engaging the outer control member 250, at which point the widest portion of the docking collar 210B remains underneath the outer portion $\mathbf{220}_O$ of the anchor 220.

The sill rail 185 may include opposing lower portions $\mathbf{185}_L$ that may define the guide portion 280 into which the anchor 220 may be positioned. However, the sealing system 200 is not limited in this manner. For example, the guide portion 280 of the sill rail 185 may be open such that the docking collars 210A, 210B and/or the control members 240, 250 directly rest upon the sill 150.

The lower portions $\mathbf{185}_L$ can act to contain the docking collars 210A, 210B and the control members 240, 250 within the guide portion 280. For example, the lower portions $\mathbf{185}_L$ may be sized such that the distance between the distal ends of the lower portions $\mathbf{185}_L$ is less the widest portion of the anchor 220 (e.g., the outer portion $\mathbf{220}_O$ of anchor 220), which prevents the anchor 220 from being withdrawn from the guide portion 280. Also, the lower portions $\mathbf{185}_L$ may be sized such that the distance between the distal ends of the opposing lower portions $\mathbf{185}_L$ is slightly greater than the width of the inner portion $\mathbf{220}_I$, of anchor 220. In so doing, side-to-side motion (e.g., left-to-right motion using the reference system of FIGS. 4A, 4B) of the sill rail 185 relative to the sill 150 can be reduced.

A member (e.g., the sill rail 185) opposite the anchor 220 may rest directly upon a top face of the anchor 220, and in so doing, can create a seal between the sill rail 185 and the anchor 220. However, the sealing system 200 is not limited in this manner. For example, the lower portions $\mathbf{185}_L$ of the sill rail 185 may rest directly on the sill 150, and a gap may exist between a top face of the anchor 220 and the sill rail 185.

In certain aspects of the sealing system 200, a portion of the sill rail 185 and/or the sill 150, where the sill rail 185 contacts the sill 150, may include a friction reducing material. This friction reducing material may be integral with the sill rail 185 and/or sill 150, or the friction reducing material may be added to the sill rail 185 and/or sill 150, for example, as a coating or as an insert.

In an unlocked configuration (i.e., FIGS. 3A, 4A) of the sealing system 200, inner faces 260 of the docking collars 210A, 210B are positioned relative to side faces 270 of the anchor 220 such that the sill rail 185 may slide relative to the sill 150. In so doing, the inner faces 260 of the docking collars 210A, 210B may be positioned away from the side faces 270 such that the inner faces 260 do not contact the sides faces 270. Alternatively, the inner faces 260 of the docking collars 210A, 210B may slightly contact the side faces 270 such that insufficient friction exits between the inner faces 260 and the sides faces 270 to prevent a user from sliding the sill rail 185 relative to the sill 150 (i.e., sliding a panel 110 within the frame 120).

Figure 4B:
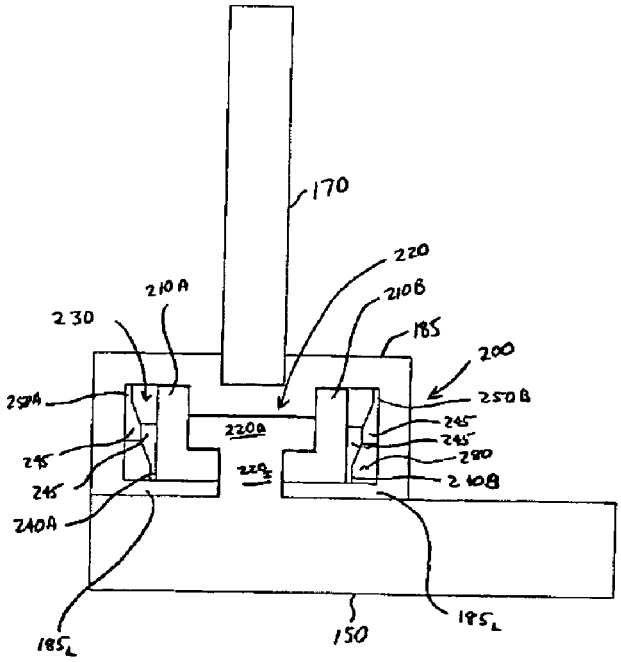
Figure 5A:
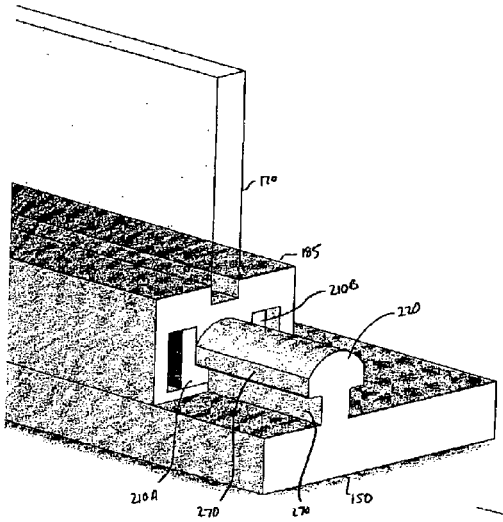
FIGS. 5A-5C are perspective views of various configurations of anchors and docking collars for the sealing system.
Figure 5B:
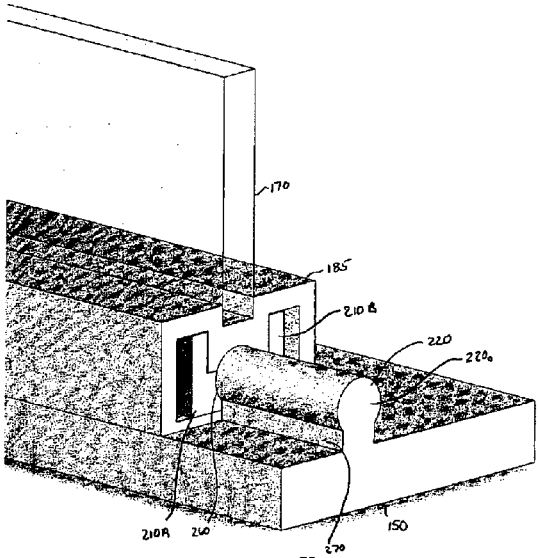
Figure 5C:
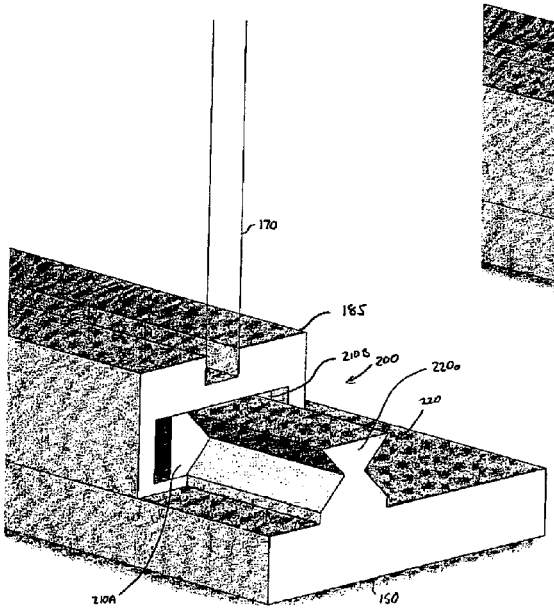

A closing system 230 moves the sealing system 200 from the unlocked configuration (i.e., FIGS. 3A, 3B) to a locked configuration (i.e., FIGS. 3B, 4B). The closing system 230 may also move the sealing system 200 from the locked configuration to the unlocked configuration. How the closing system 230 moves the sealing system 200 from the unlocked configuration to the locked configuration (and back again) is not limited as to a particular manner or device. For example, a screw drive (not shown) may be used to move the docking collars 210A, 210B towards one another and towards the anchor 220. In another example, the docking collars 210A, 210B and/or the anchor 220 may be electromagnetically energized to attract the docking collars 210A, 210B to the anchor 220. Other devices capable of moving the docking collars 210A, 210B towards one another and towards the anchor 220 are commonly known, and the closing system 230 is not limited as to a particular device.

In certain aspects of the closing system 230, as illustrated in FIGS. 3A, 4A and 3B, 4B, the closing system 230 includes inner control members 240A, 240B and outer control members 250A, 250B. The outer control members 250A, 250B are respectively disposed proximate to the first and second inner control members 240A, 250B. The inner control members 240A, 240B are respectively connected to (or integral with) the docking collars 210A, 210B.

The closing system 230 moves the sealing system 200 from the unlocked configuration to the locked configuration upon the relative movement of the outer control members 250A, 250B to the inner control members 240A, 240B along a line substantially parallel to a longitudinal axis of one of the control members 240, 250. This movement generates a force against the first and second inner control members 240A, 240B towards the anchor 220, which causes the docking collars 210A, 210B to move towards one another and towards the anchor 220.

The manner in which the relative movement between the inner and outer control members 240, 250 is created is not limited as to a particular device. For example, either at least one of the inner control members 240 or the outer control members 250 may be connected to a handle (not shown) that is operable by the user to move the outer control members 250A, 250B relative to the inner control members 240A, 240B. As another example, either at least one of the inner control members 240 or the outer control members 250 may be connected to a mechanical, an electrical, or an electromechanical device (not shown) that moves the outer control members 250A, 250B relative to the inner control members 240A, 240B. Other devices capable of moving the outer control members 250A, 250B relative to the inner control members 240A, 240B are commonly known, and the closing system 230 is not limited as to a particular device.

Additionally, separate devices may separately move each of the outer control members 250A, 250B relative to each of the inner control members 240A, 240B. Alternatively, a single device may move both of the outer control members 250A, 250B relative to both of the inner control members 240A, 240B, and the manner in which both of the outer control members 250A, 250B are moved relative to both of the inner control members 240A, 240B is not limited to a particular device. For example, the first and second outer control members 250A, 250B may be interconnected with at least one connector 235 (see FIGS. 13A, 13B) so that movement of either the first or second outer control member 250A, 250B moves the other.

The inner and outer control members 240, 250 may each include a step 245 proximate to each other, and these proximate pairs of steps 245 on the inner and outer control members 240, 250 may face each other. Movement of the outer control members 250 relative to inner control members 240 to position the sealing system 200 in the locked configuration causes the proximate pairs of steps 245 to engage one another and to separate a distance between proximate pairs 250A, 240A and 240B, 250B of the inner and outer control members 240, 250, and any configuration of steps 245 so capable are acceptable for use with the closing system 230. For example, one of the steps 245 may include an inclined surface between first and second levels and the other of the steps 245 may include a roller. Also, the first and second levels respectively of the inclined step 245 may have different distances from the other step 245 such that, as the roller moves on the inclined surface from a first level to a second level, a distance between the steps 245 of the proximate pair (and also between the inner and outer control members 240, 250) increases (or decreases).

In a current aspect of the closing system 230, each of the proximate pair of the steps 245 includes an inclined surface between first and second levels that are respectively at different distances from the other step 245. As the inner and outer control members 240, 250 move relative to one another, the inclined surfaces of the proximate pair of steps engage each other and cause a distance to increase between the proximate pairs 250A, 240A and 240B, 250B of the inner and outer control members 240, 250. The engagement of the inclined surfaces also creates a smoother transition between the unlocked configuration and the locked configuration of the sealing system 200.

The closing system 230 is not limited as to the particular manner in which the sealing system 200 is positioned from the locked position to the unlocked position. For example, upon the inner and outer control members 240, 250 moving relative to one another to cause a distance to decrease between the proximate pairs 250A, 240A and 240B, 250B of the inner and outer control members 240, 250, a resilient member (or other device) may move the docking collars 210A, 210B away from the anchor 220, thereby reducing a force exerted by the docking collars 210A, 210B against the anchor 220.

In the locked configuration of the sealing system 200, the inner faces 260 of the docking collars 210A, 210B are positioned against the side faces 270 of the anchor 220 to prevent the sill rail 185 from moving relative to the sill 150. The sill rail 185 is prevented from moving relative to the sill 150 by friction between the inner faces 260 of the docking collars 210A, 210B and the side faces 270 of the anchor 220. The inner faces 260 of the docking collars 210A, 210B respectively engaging the side faces 270 of the anchor 220 may create a pair of seals on both sides of the anchor 220.

Although the docking collars 210A, 210B are shown as being moved towards one another along a common axis, the sealing system 200 is not limited in this manner. For example, the closing system 230 may cause the docking collars 210A, 210B to move both towards one another and either upwards or downwards. In this manner, additional seals may be created between the docket collars 210A, 210B and additional members of the door/window system 100, such as the anchor 220, the sill 150, and/or the sill rail 185.

In certain aspects of the sealing system 200, the forces created by the docking collars 210A, 210B engaging the anchor 220 mirror one another. In this manner, components of the forces, along a particular axis, may offset each other. For example, in the configuration described in the immediately preceding paragraph, the forces created by the docking collars 210A, 210B being pressed against the anchor include offsetting components in an x-direction and components in a y-direction.

Additionally, as illustrated in FIGS. 4A, 4B, the forces created by the docking collars 210A, 210B engaging the anchor 220 directly oppose each other. In so doing, these forces may completely cancel each other and create no upward or downward forces against the anchor 220.

Figure 6A:
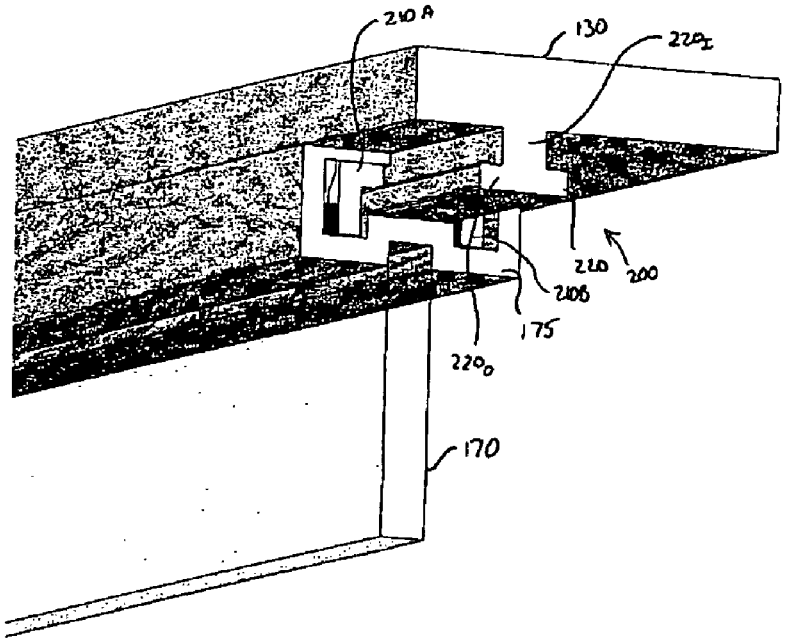
FIGS. 6A and 6B are perspective views, respectively, of a sealing system between a header and a header rail in locked and unlocked configurations in accordance with the inventive arrangements.
Figure 6B:
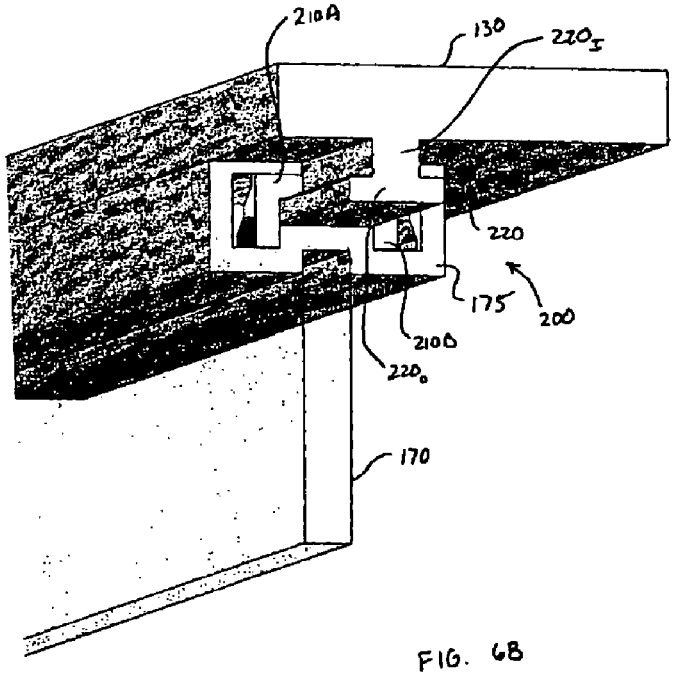

As illustrated in FIGS. 6A, 6B, a sealing system 200 connecting the header 130 of the frame 120 to the header rail 175 may be nearly identical in configuration to the sealing system 200 illustrated in FIGS. 3A, 3B and 4A, 4B. Thus, the sealing system 200 connecting the header 130 to the header rail 175 may include many or all of the elements of the sealing system 200 illustrated in FIGS. 3A, 3B and 4A, 4B.

In certain aspects, lower faces of the widest portions of the docking collars 210A, 210B may rest upon top faces of the outer portion $220_O$ of the anchor 220, and in so doing, may create a seal between the header rail 175 and the anchor 220. However, the sealing system 200 is not limited in this manner. For example, lower portions of the docking collars 210A, 210B may rest directly on the inner surface of the guide portion 280 within the header rail 175, and a gap may exist between a top faces of the outer portion $220_O$ of the anchor 220 and the lower faces of the widest portions of the docking collars 210A, 210B.

Figure 7A:
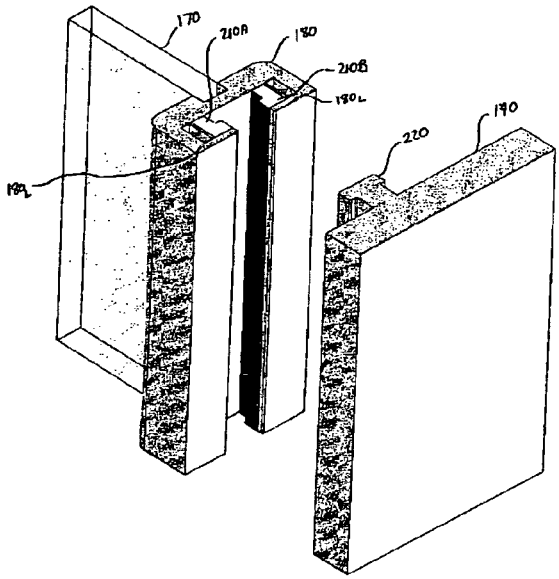
FIGS. 7A-7C are perspective views, respectively, of a sealing system between a jamb and stile rail in separated, locked, and unlocked configurations in accordance with the inventive arrangements.
Figure 7B:
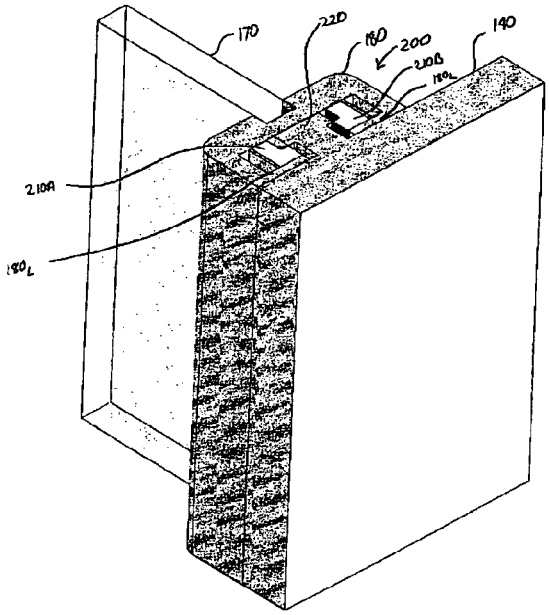
Figure 7C:
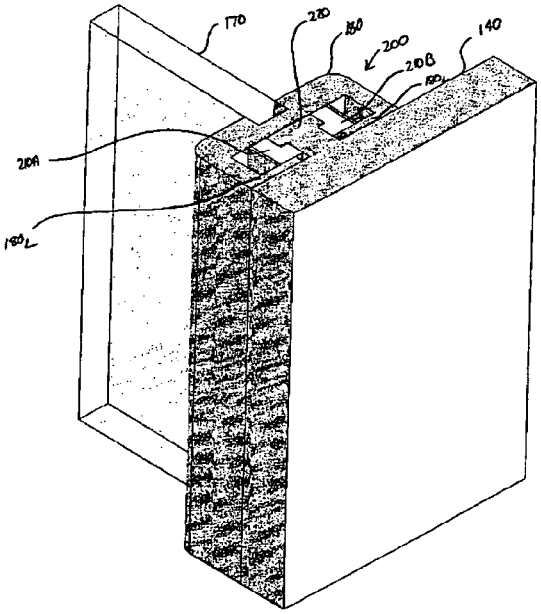

FIGS. 7A, 7B, and 7C respectively illustrate the stile rail 180 of a panel 110 positioned away from the jamb 140 of the frame 120; the stile rail 180 engaged with the jamb 140 with the sealing system 200 in an unlocked configuration; and the stile rail 180 engaged with the jamb 140 with the sealing system 200 in a locked configuration. The sealing system 200 connecting the stile rail 180 to the jamb 140 may be nearly or completely identical in configuration to the sealing system 200 illustrated in FIGS. 3A, 3B and 4A, 4B.

In certain aspects of the sealing system 200, the stile rail 180 may include opposing lower portions $180_L$ that define a guide portion 280 into which the anchor 220 may be positioned. Also, the lower portions $185_L$ may be sized such that the distance between the distal ends of the lower portions $185_L$ is greater than the width of the outer portion $220_O$ of anchor 220 (i.e., the widest portion of the anchor 220). In so doing, the anchor 220 may be inserted into (and withdrawn from) the guide portion 280.

Additionally, with regard to the sealing system 200 for the jamb 140 and stile rail 180, the docking collars 210A, 210B may extend beyond the outer portion $220_O$ of anchor 220 in an unlocked configuration (i.e., FIG. 7B). In so doing, the docking collars 210A, 210B may be separated from the anchor 220, and the jamb 140 may be disengaged from the stile rail 180 (i.e., FIG. 7A).

Figure 8A:
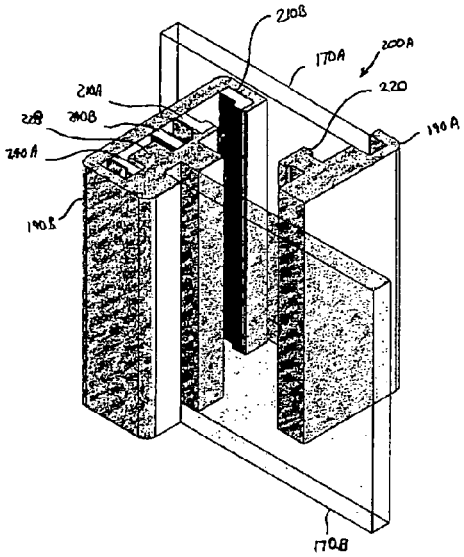
FIGS. 8A-8C are perspective views, respectively, of a sealing system between meeting stiles of a pair of panels in separated, locked, and unlocked configurations in accordance with the inventive arrangements.
Figure 8B:
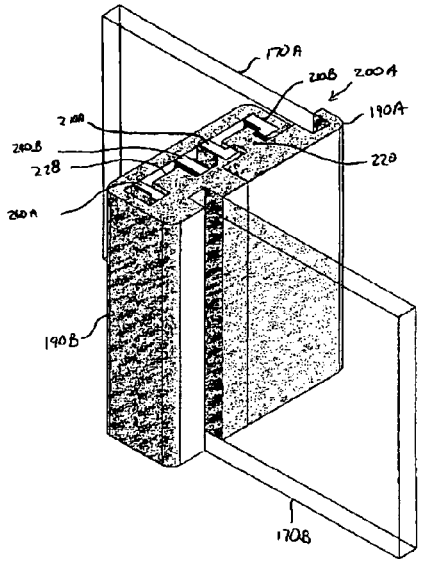
Figure 8C:
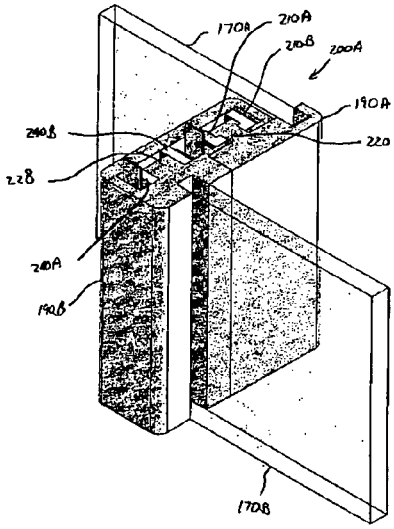

FIGS. 8A, 8B, and 8C illustrate another aspect of a sealing system 200A respectively in a separated configuration, an unlocked configuration, and in a locked configuration. The sealing system 200A connects meeting stiles 190A, 190B of the panels 110A, 110B, although the sealing system 200 is not limited in this manner and can be used between other features in the door/window system 100. As illustrated, the sealing system 200 may be nearly identical in configuration to the sealing system 200 illustrated in FIGS. 7A-7C. However, as will be described in greater detail in reference to FIGS. 14A and 14B, a closing system 230 used with the sealing system 200A employs inner and outer control members 240, 250 that are not immediately adjacent to the docking collars 210A, 210B. Also, the second meeting stile 190B includes a stop member 228 that limits the relative movement of the inner and outer control members 240, 250.

Figure 9A:
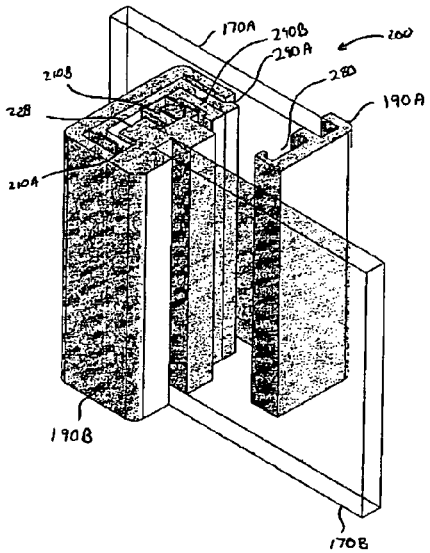
FIGS. 9A-9C are perspective views, respectively, of another sealing system between meeting stiles of a pair of panels in separated, locked, and unlocked configurations in accordance with the inventive arrangements.
Figure 9B:
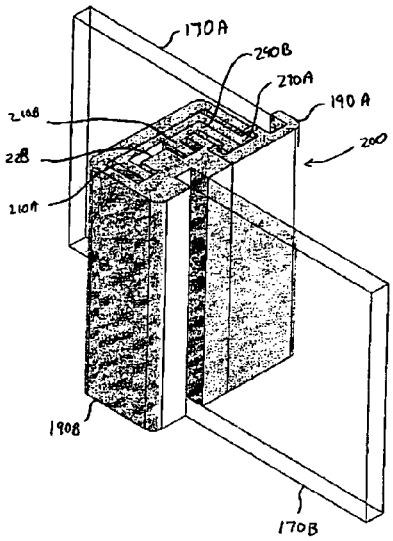
Figure 9C:
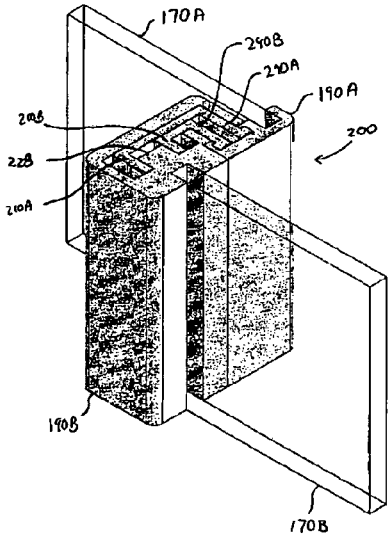
Figure 10A:
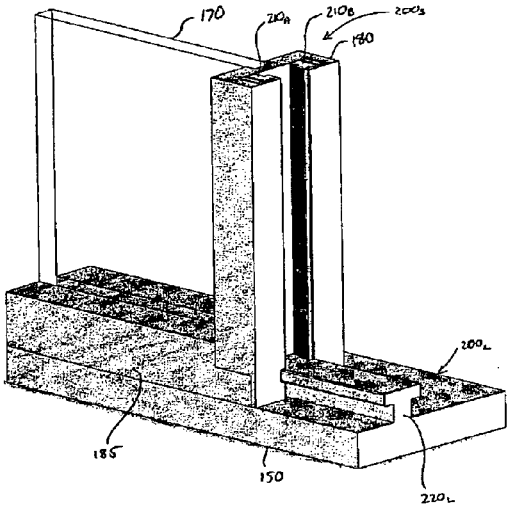
FIGS. 10A-10C are partial perspective views without the jamb, respectively, of a combined sealing system between the sash of a panel and a frame in separated, locked, and unlocked configurations in accordance with the inventive arrangements.
Figure 10B:
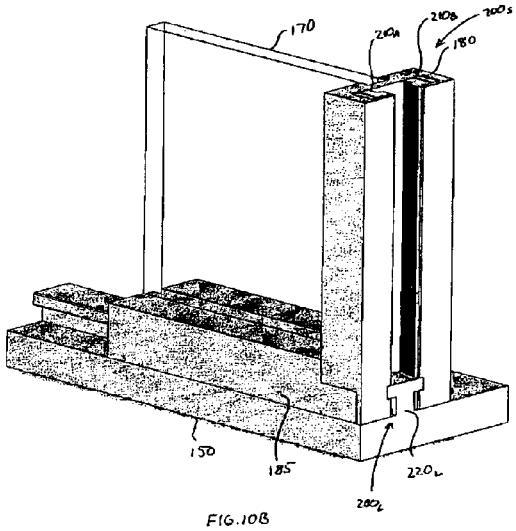
Figure 10C:
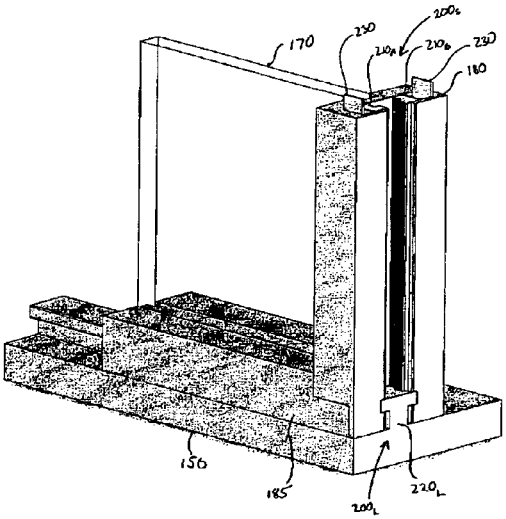
Figure 11A:
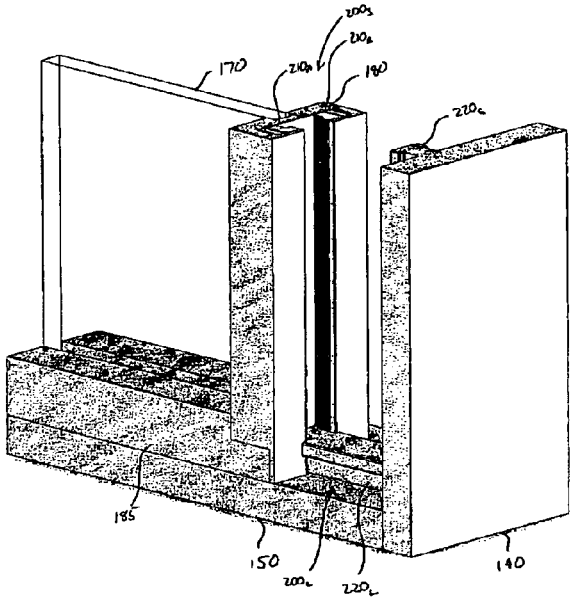
FIGS. 11A-11C are perspective views of FIGS. 10A-10C with the jamb.
Figure 11B:
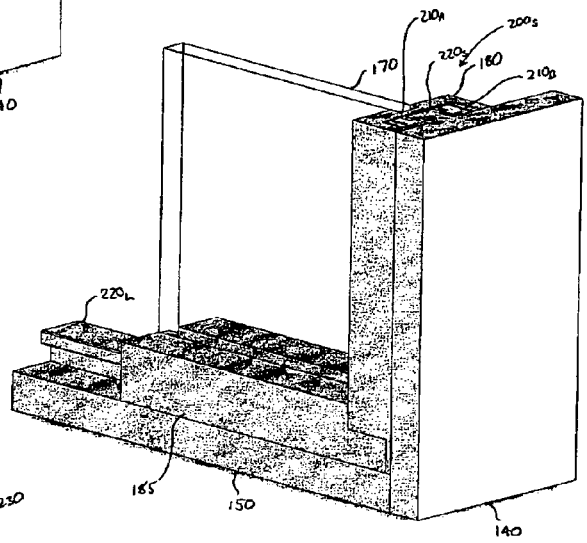
Figure 11C:
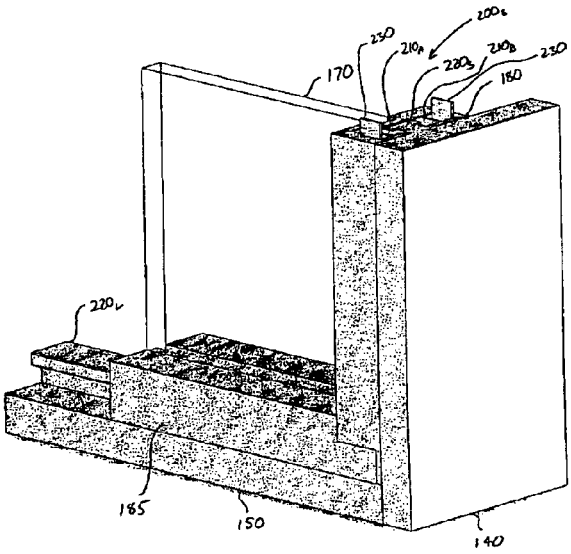
Figure 12A:
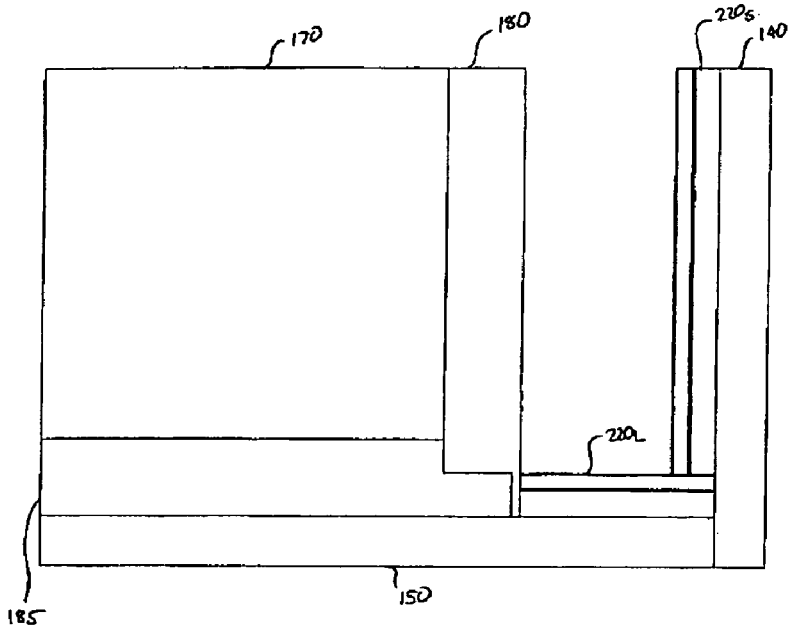
FIGS. 12A and 12B are side views of FIGS. 11A and 11B.
Figure 12B:
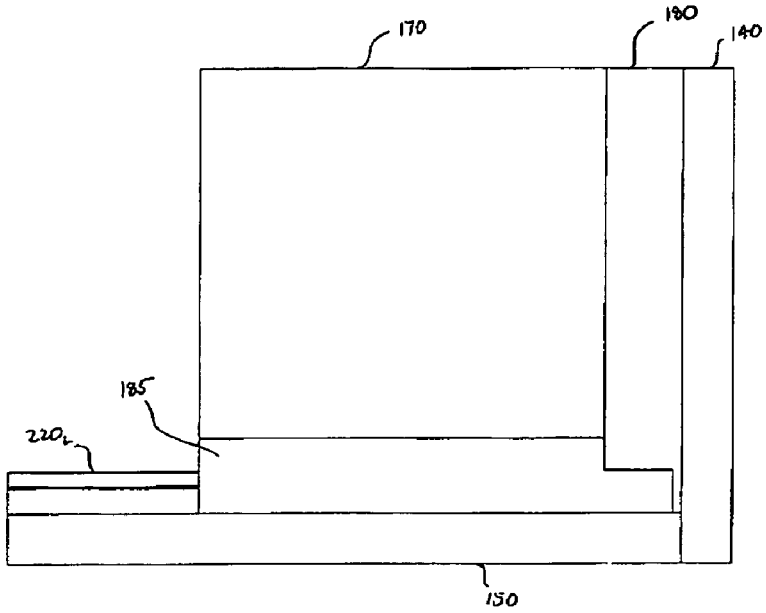

FIGS. 9A, 9B, and 9C illustrate another aspect of a sealing system 200A respectively in a separated configuration, an unlocked configuration, and in a locked configuration. As illustrated, the sealing system 200 connects meeting stiles 190A, 190B of the panels 110A, 110B, although the sealing system 200 is not limited in this manner and can be used between other features in the door/window system 100. This sealing system 200A differs from the other sealing systems 200 described herein in that the anchor 220 is a split anchor that in the locked configuration engages the guide portion 280 to prevent relative movement of the first panel 110A to the second panel 110B. In an unlocked configuration a widest portion of the split anchor 220 is smaller than a dimension of the opening into the guide portion 280, which allows for the split anchor 220 to be removed from the guide portion.

As will be described in greater detail in reference to FIGS. 15A and 15B, a closing system 230 used with the sealing system 200A employs inner and outer control members 240, 250, separate from the meeting stile of the first panel A, that are connected to the separate portions of the split anchor 220. Also, the second meeting stile 190B includes a stop member 228 that limits the relative movement of the inner and outer control members 240, 250.

FIGS. 10A-10C, 11A-11C, and 12A-12B illustrate combined sealing systems $200_L$, $200_S$ for providing seals between a pair of substantially perpendicular surfaces (e.g., stile rail 180 and sill rail 185) on a panel 110 and a pair of substantially perpendicular surfaces (e.g., jamb 140 and sill 150) on a frame 120. As one skilled in the art would recognize, the combined sealing mechanisms may be between other sets of substantially perpendicular surfaces than those illustrated. Although not limited in this manner, one sealing mechanism $200_L$ may be similar to the sealing mechanism 200 described with regard to FIGS. 3A-B and 4A-B, and the other sealing mechanism 200S may be similar to the sealing mechanism 200 described with regard to FIGS. 7A-C. When the sealing systems $200_L$, $200_S$ are in a locked configuration, both of the sealing systems $200_L$, $200_S$ separately prevent the movement of the panel 110 relative to the frame 120. In certain aspects, each of the anchors $200_L$, $200_S$ are directly connected to each other.

Figure 13A:
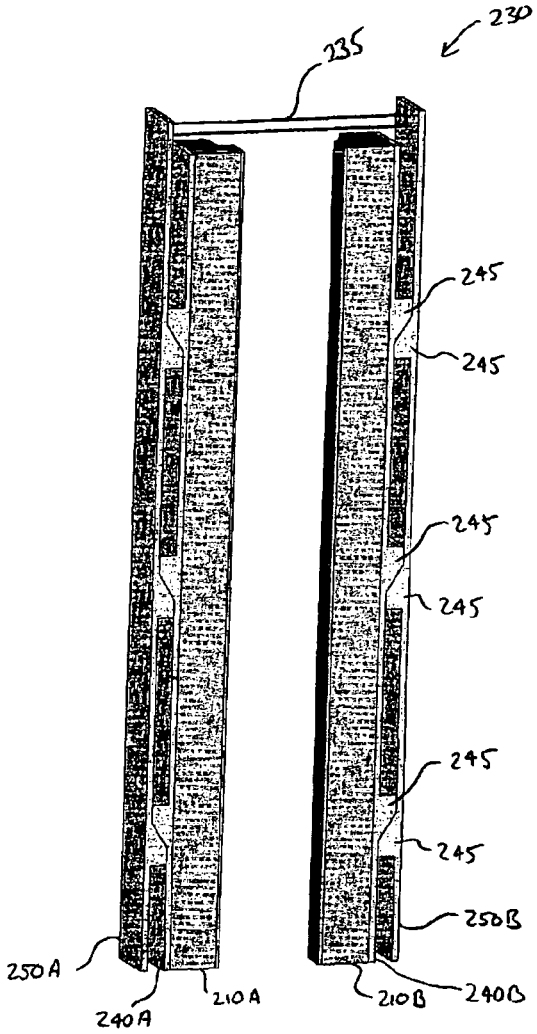
FIGS. 13A and 13B are perspective views, respectively, of a closing system for use with the sealing system illustrated in FIGS. 7A-7C in locked and unlocked configurations in accordance with the inventive arrangements.
Figure 13B:
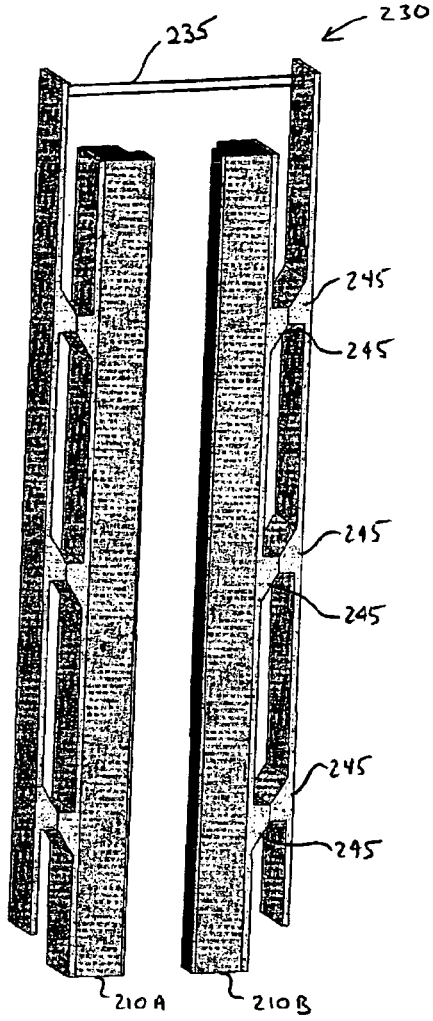

FIGS. 13A-13B, 14A-14B, 15A-15B, 16A-16B, and 17A-17B illustrate additional examples of the closing system 230 previously described with regards to FIGS. 3A-3B and 4A-4B. FIGS. 13A-13B illustrate a closing system 230 used, for example, with the sealing system illustrated in FIGS. 7A-7C. As shown, the closing system 230 moves the sealing system from the unlocked configuration (i.e., FIG. 13A) to a locked configuration (i.e., FIG. 13B) by moving outer control members 250A, 250B relative to inner control members 240A, 240B along a line substantially parallel to a longitudinal axis of one of the control members 240, 250. This movement creates a force against the first and second inner control members 240A, 240B towards the anchor 220 (not shown) and causes the docking collars 210A, 210B to move towards one another and towards the anchor 220.

As will be described in more detail below, the inner and outer control members 240, 250 of a particular sealing system 200 may be connected to other inner and outer control members 240, 250 of at least one other sealing system 200. In this manner, the movement of one of the inner control members 240A, 240B or the outer control members 250A, 250B may move inner or outer control members 240, 250 of other sealing systems 200. In certain aspects, all of the closing systems 230 of a particular panel are interconnected such that all of the outer control members 250A, 250B for each closing system 230 are interconnected. In this manner, the movement of a single set of outer control members 250A, 250B moves all of the other outer control members 250A, 250B.

Figure 14B:
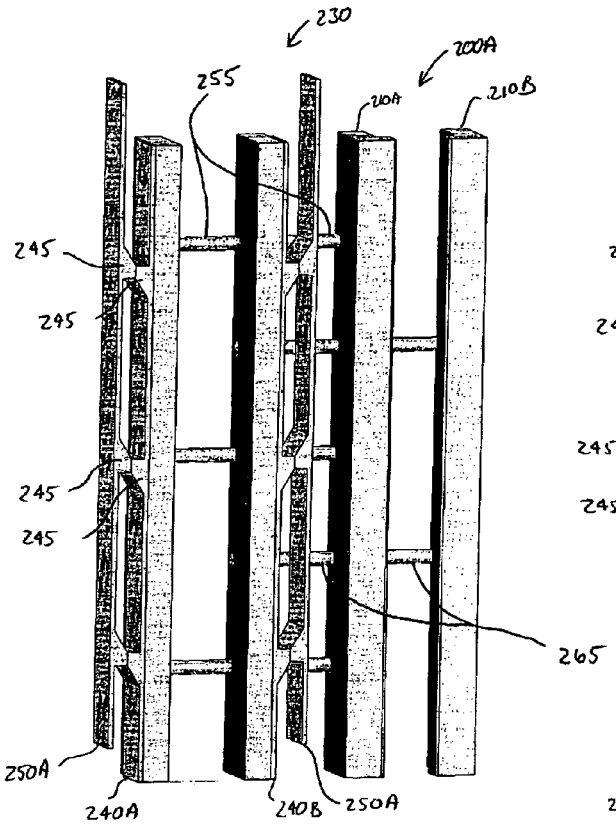
FIGS. 14A and 14B are perspective views, respectively, of a closing system for use with the sealing system illustrated in FIGS. 8A-8C in locked and unlocked configurations in accordance with the inventive arrangements.
Figure 14A:
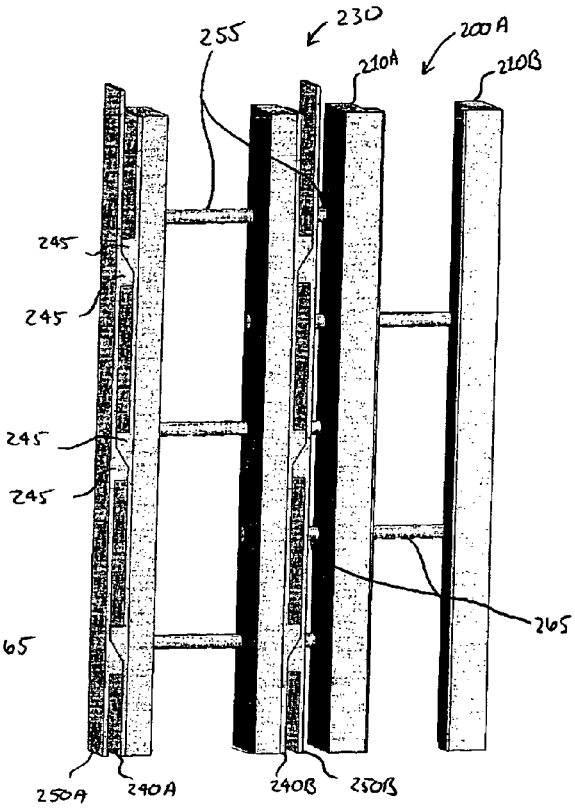

FIGS. 14A-14B illustrate a closing system 230 used, for example, with the sealing system illustrated in FIGS. 8A-8C. As shown, the closing system 230 moves the sealing system 200A from the unlocked configuration (i.e., FIG. 14A) to a locked configuration (i.e., FIG. 14B) by moving outer control members 250A, 250B relative to inner control members 240A, 240B along a line substantially parallel to a longitudinal axis of one of the control members 240, 250. This movement creates a force against the first and second inner control members 240A, 240B and causes the first and second inner control members 240A, 240B to move towards one another.

Additionally, the first inner control member 240A may be connected to first docking collar 210A of the sealing system 200A via at least one first docking collar connector 255. The second outer control member 250B may be connected to the second docking collar 210B of the sealing system 200A via at least one second docking collar connector 265. The inner and outer control members 240, 250, may be connected to other inner and outer control members 240, 250 of other sealing systems 200, for example, to the inner and outer control member 240, 250 of a sealing system 200 connecting the header 130 to a header rail 175 (e.g., see FIGS. 6A and 6B) or of a sealing system 200 connecting the sill 150 to the sill rail 185 (e.g., see FIGS. 3A-3B and 4A-4B). In this manner, relative movement of one set of inner and outer control members 240, 250 creates relative movement between one or more additional sets of inner and outer control members 240, 250.

Figure 15A:
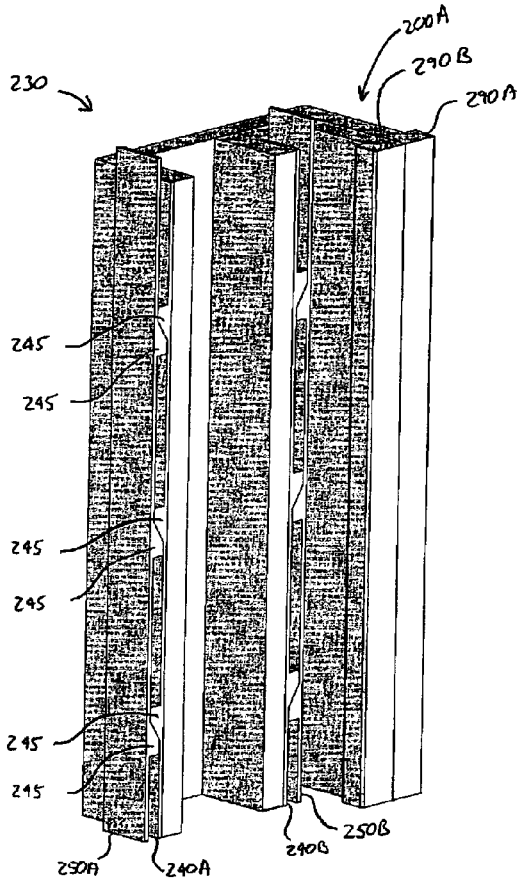
FIGS. 15A and 15B are perspective views, respectively, of a closing system for use with the sealing system illustrated in FIGS. 9A-9C in locked and unlocked configurations in accordance with the inventive arrangements.
Figure 15B:
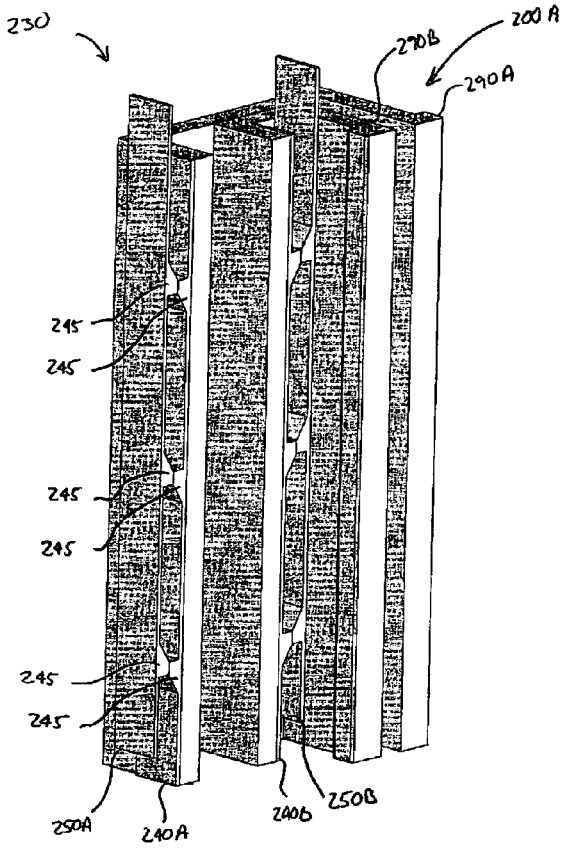
Figure 16A:
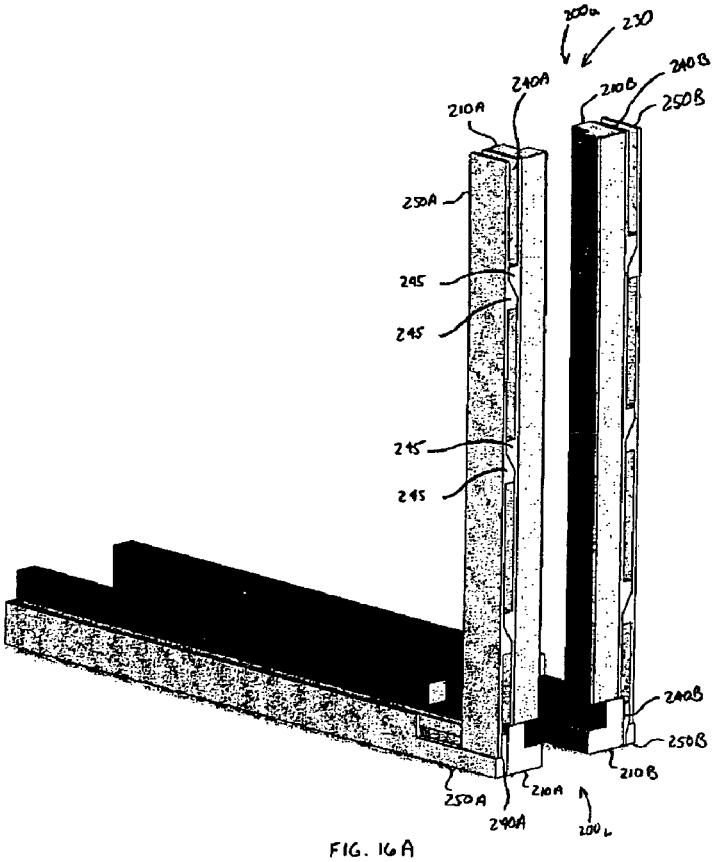
FIGS. 16A and 16B are perspective views, respectively, of a closing system for use with the sealing system illustrated in FIGS. 10A-10C, 11A-11C, and 12A-12B in locked and unlocked configurations in accordance with the inventive arrangements.
Figure 16B:
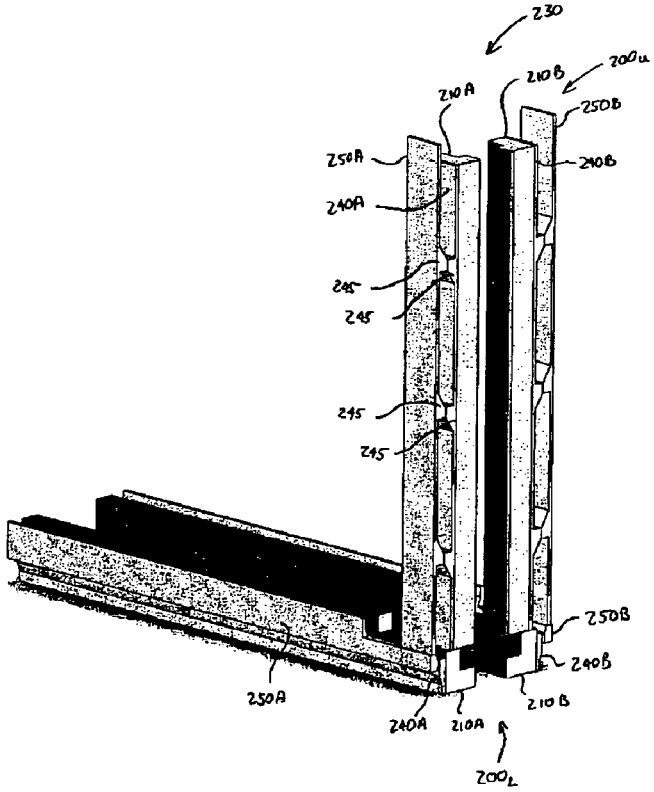
Figure 17A:
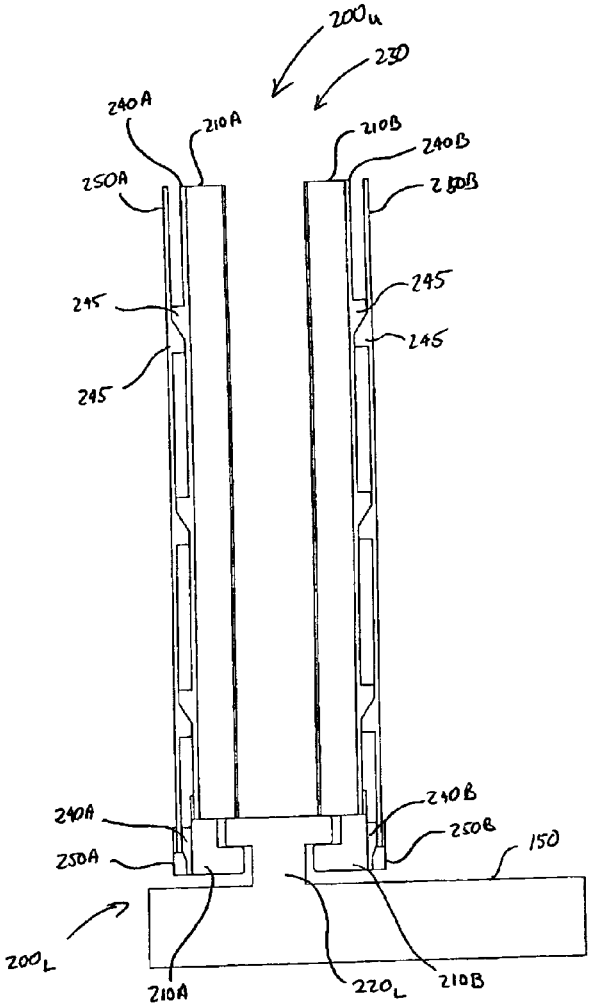
FIGS. 17A and 17B are side views of FIGS. 16A and 16B with the anchor and sill shown.
Figure 17B:
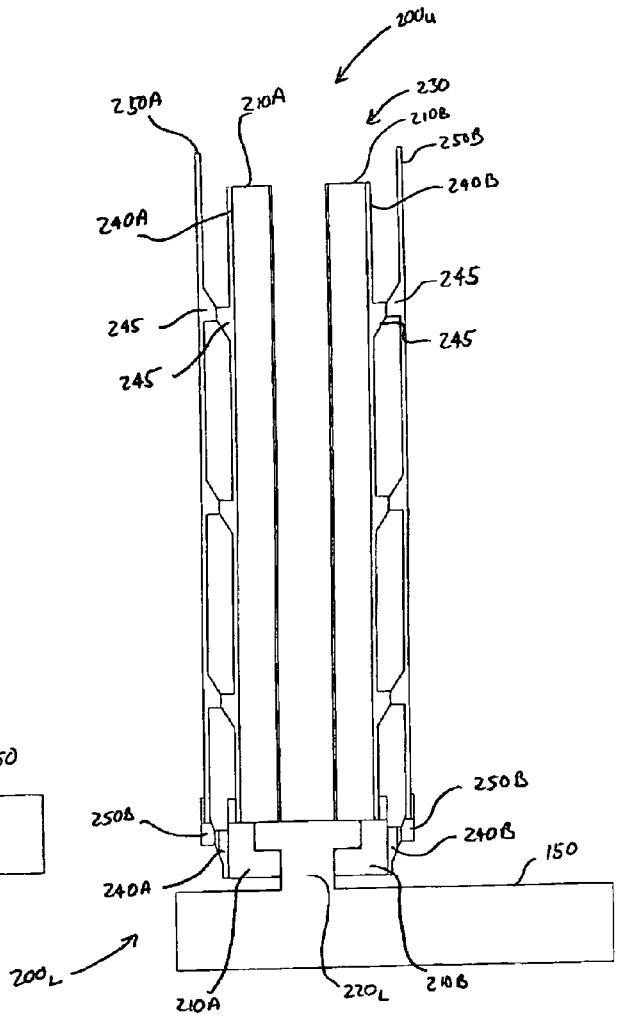

FIGS. 15A-15B illustrate a closing system 230 used, for example, with the sealing system illustrated in FIGS. 9A-9C. As shown, the closing system 230 moves the sealing system 200A from the unlocked configuration (i.e., FIG. 15A) to a locked configuration (i.e., FIG. 15B) by moving outer control members 250A, 250B relative to inner control members 240A, 240B along a line substantially parallel to a longitudinal axis of one of the control members 240, 250. This movement creates a force against the first and second inner control members 240A, 240B and causes the first and second inner control members 240A, 240B to move towards one another. Additionally, since the first and second inner control members 240A, 240B are respectively connected to the separate elements of the split anchor 290A, 290B, the first and second inner control members 240A, 240B moving towards one another causes the separate elements of the split anchor 290A, 290B to move away from each other and towards the guide portion 280 of the first sealing system 200A.

The inner and outer control members 240, 250, may be connected to other inner and outer control members 240, 250 of other sealing systems 200, for example, to the inner and outer control member 240, 250 of a sealing system 200 connecting the header 130 to a header rail 175 (e.g., see FIGS. 6A and 6B) or of a sealing system 200 connecting the sill 150 to the sill rail 185 (e.g., see FIGS. 3A-3B and 4A-4B). In this manner, relative movement of one set of inner and outer control members 240, 250 creates relative movement between one or more additional sets of inner and outer control members 240, 250.

FIGS. 16A-16B and 17A-17B illustrate a closing system 230 used, for example, with the combined sealing system illustrated in FIGS. 10A-10C, 11A-11C, and 12A-12B. As shown, the closing system 230 moves the combined sealing system from the unlocked configuration (i.e., FIGS. 16A, 17A) to a locked configuration (i.e., FIGS. 16B, 17B) by moving outer control members 250A, 250B relative to inner control members 240A, 240B along a line substantially parallel to a longitudinal axis of one of the control members 240, 250.

The inner and outer control members 240, 250 of one sealing system $200_L$ may be connected to the inner and outer control members 240, 250 of the other sealing system $200_S$. In this manner, relative movement of one set of inner and outer control members 240, 250 creates relative movement between one or more additional sets of inner and outer control members 240, 250. Thus, the relative movement of the inner and outer control members 240, 250 creates a force against the first and second inner control members 240A, 240B towards the anchors $\mathbf{220}_L$, $\mathbf{220}_S$ of both the first and second sealing systems $\mathbf{200}_L$, $\mathbf{200}_S$ and causes the docking collars 210A, 210B of both the first and second sealing systems $\mathbf{200}_L$, $\mathbf{200}_S$ to move towards one another and towards the anchors $\mathbf{220}_L$, $\mathbf{220}_S$.

What is claimed is:

1. A closing system for moving a combined sealing system between an unlocked configuration and a locked configuration, the combined sealing system connecting a panel to a frame and including a first sealing system and a second sealing system, each of the first and second sealing systems including an anchor disposed between first and second opposing docking collars and the anchor of the first sealing system substantially perpendicular to the anchor of the second sealing system, comprising:

an inner control member connected to one of the first and second docking collars of both the first and second sealing systems; and an outer control member disposed proximate to the inner control member, wherein the outer control member movable relative to the inner control member along a line substantially parallel to a longitudinal axis of one of the control members, and movement of the outer control member relative to the inner control member along the line generates a force against the inner control member towards the anchors when the sealing system moves from the unlocked configuration to the locked configuration, wherein each control member of a proximate pair of the inner and outer control members includes a step that slide relative to each other, increasing or decreasing the distance between the collars.

2. The closing system of claim 1, wherein the movement, along the line, of first and second outer control members relative to first and second inner control members moves each of the first and second inner control members towards the anchors.

3. The closing system of claim 1, wherein the movement, along the line, of the outer control member relative to the inner control member increases a distance separating a proximate pair of the inner and outer control members.

4. The closing system of claim 1, wherein in the locked configuration, the steps engage one another.

5. The closing system of claim 1, wherein each control member of the proximate pair of the inner and outer control members includes a plurality of separate steps.

6. The closing system of claim 1, wherein first and second outer control members are interconnected with at least one connector.

* * * * *